US006406317B1

(12) United States Patent
Li et al.

(10) Patent No.: US 6,406,317 B1
(45) Date of Patent: Jun. 18, 2002

(54) ZERO INSERTION FORCE ELECTRICAL CONNECTOR

(75) Inventors: Ren-Zhi Li; Yao-Chi Huang, both of Tu-Chen (TW); David Gregory Howell, Chandler, AZ (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/893,084

(22) Filed: Jun. 26, 2001

(30) Foreign Application Priority Data

May 11, 2001 (TW) ..... 90207763 U

(51) Int. Cl.[7] ..... H01R 13/62
(52) U.S. Cl. ..... 439/342; 439/259
(58) Field of Search ..... 439/342, 259–260, 439/525

(56) References Cited

U.S. PATENT DOCUMENTS 6,083,028 A * 7/2000 Pei et al. ..... 439/342
6,210,199 B1 * 4/2001 Walkup et al. ..... 439/342
6,280,223 B1 * 8/2001 Lin ..... 439/342
6,338,639 B1 * 1/2002 Trout et al. ..... 439/342

* cited by examiner

*Primary Examiner*—Hien Vu
(74) *Attorney, Agent, or Firm*—Wei Te Chung

(57) ABSTRACT

An electrical connector (1) includes a base (10) securely assembled to a printed circuit board, a number of terminals (12) received in the base, a cover (20) moveably assembled to the base and a driving device (40). The cover defines a number of through holes (21) for extension of corresponding pins (31). The driving device is arranged between the base and the cover to move the cover between first and second positions. The base defines a lever rest (14) which defines a central slot (100) having a recess (101). The driving device includes a driving shaft (41) and a follower (46). The driving shaft has a helical section (43) and a bearing section (410). The bearing section bears against a central slot in a first direction and an edge of the helical section pushing the follower in an opposite second direction during an actuation stroke of the driving shaft.

11 Claims, 5 Drawing Sheets

ZERO INSERTION FORCE ELECTRICAL CONNECTOR

BACKGROUND OF THE INVENTION

1. Field of the Invention

The present invention relates to an electrical connector, and particularly to a Zero Insertion Force (ZIF) electrical connector for electrically assembling a chip module to a printed circuit board.

2. Description of the Related Art

The related detailed description about a ZIF electrical connector and its operation of the relevant ye is disclosed in U.S. patent application filed by Wei-Yao Lin and entitled "Zero Inserted Force Connector Socket With Helical Driving Mechanism" which was filed on Feb. 9, 2000 and has a Ser. No. 09/501,333, now U.S. Pat. No. 6,280,223.

In the above pending application, a driving shaft provides an effective stroke in which pins of a CPU and contacting terminals in a base member may be effectively and electrically coupled by the movement of an upper cover member driven by the driving shaft In assembly, the driving shaft is retained on the base member via two ends thereof. However, when a force is applied on the driving shaft to rotate the driving shaft, the driving shaft is subjected to a force parallel to the axial direction of the driving shaft during its entire stroke of rotation. Thus, it is likely that the driving shaft will be driven upward by such force, especially in light of the length of the driving shaft which is substantially longer for providing a long stroke for establishing desired electrical connections between the pins and the contacting terminals. Therefore, if the stroke of the upper cover member is relatively long, the connections between the pins and the contacting terminals will be adversely effected.

BRIEF SUMMARY OF THE INVENTION

A main object of the present invention is to provide a ZIF electrical connector for reducing distortion of a driving shaft defined therein and further to obtain a stable stroke thereof.

In order to achieve the above object set forth, an electrical connector includes a base securely assembled to a printed circuit board, a number of terminals received in the base, a cover moveably assembled to the base and a driving device. The cover defines a number of through holes for extension of corresponding pins. The driving device is arranged between the base and the cover to move the cover between first and second positions. The base defines a lever rest which defies a central slot having a recess. The driving device includes a driving shaft and a follower. The driving shaft has a helical section and a bearing section. The bearing section bears against a central slot in a first direction and an edge of the helical section pushing the follower in an opposite second direction during an actuation stroke of the driving shaft, i.e., the period of moving the cover to the open position where the CPU pins can be freely loaded to or unloaded from the corresponding contacts. A shaft clip is located in the base and at an end of the driving shaft, and including a platform and a protrusion extended from a side of the platform. Wherein the shaft clip bears against an end of the driving shaft in the second direction and another edge of the helical section pushes the follower in the first direction during a de-actuation stroke, i.e., the period to move the cover to a closed position where the CPU pins engage the corresponding contacts.

Other objects, advantages and novel features of the invention will become more apparent from the following detailed description of the present embodiment when taken in conjunction with the accompanying drawings.

DETAILED DESCRIPTION OF THE INVENTION

Figure 1:
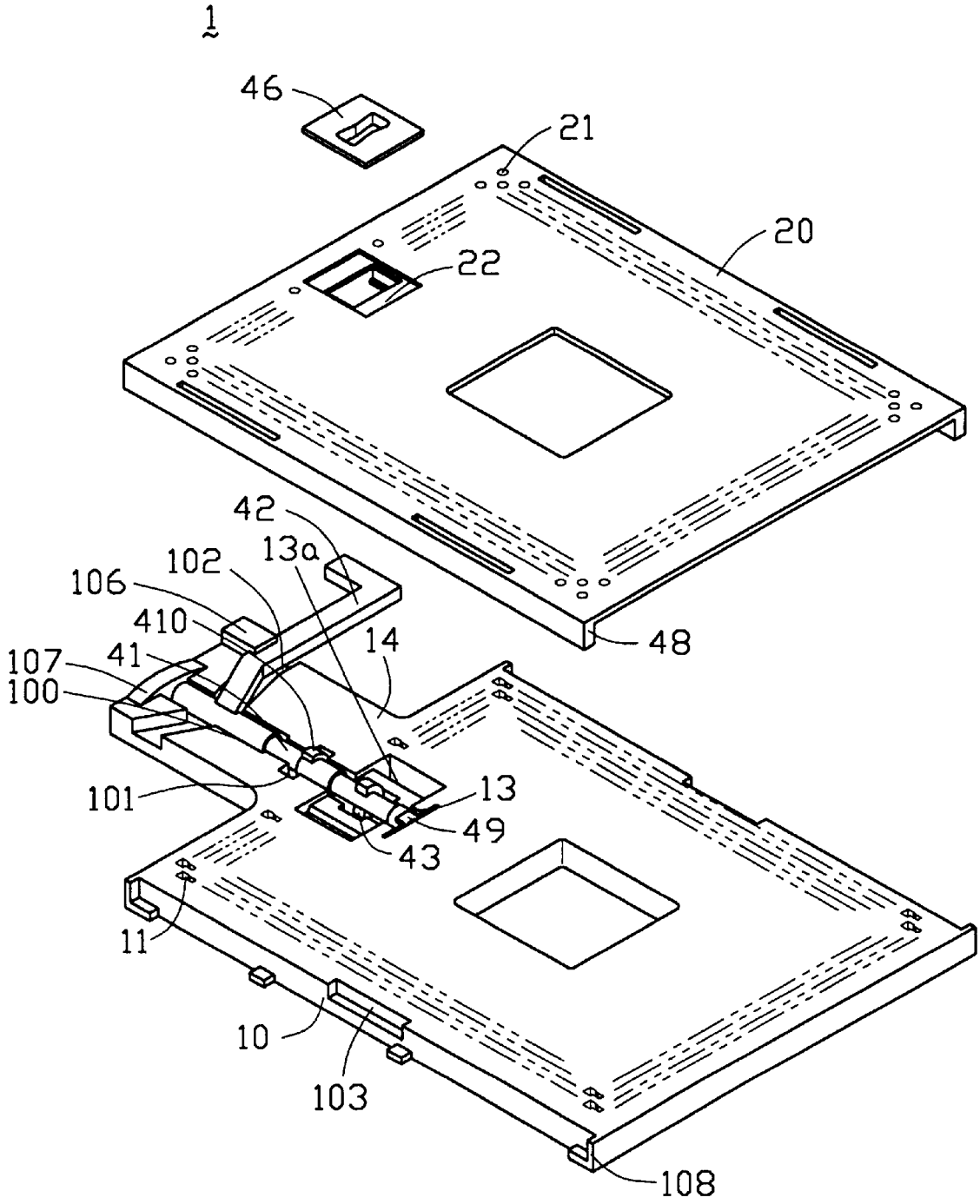
FIG. 1 is an exploded view of an electrical connector in accordance with the first embodiment of the present invention.
Figure 2:
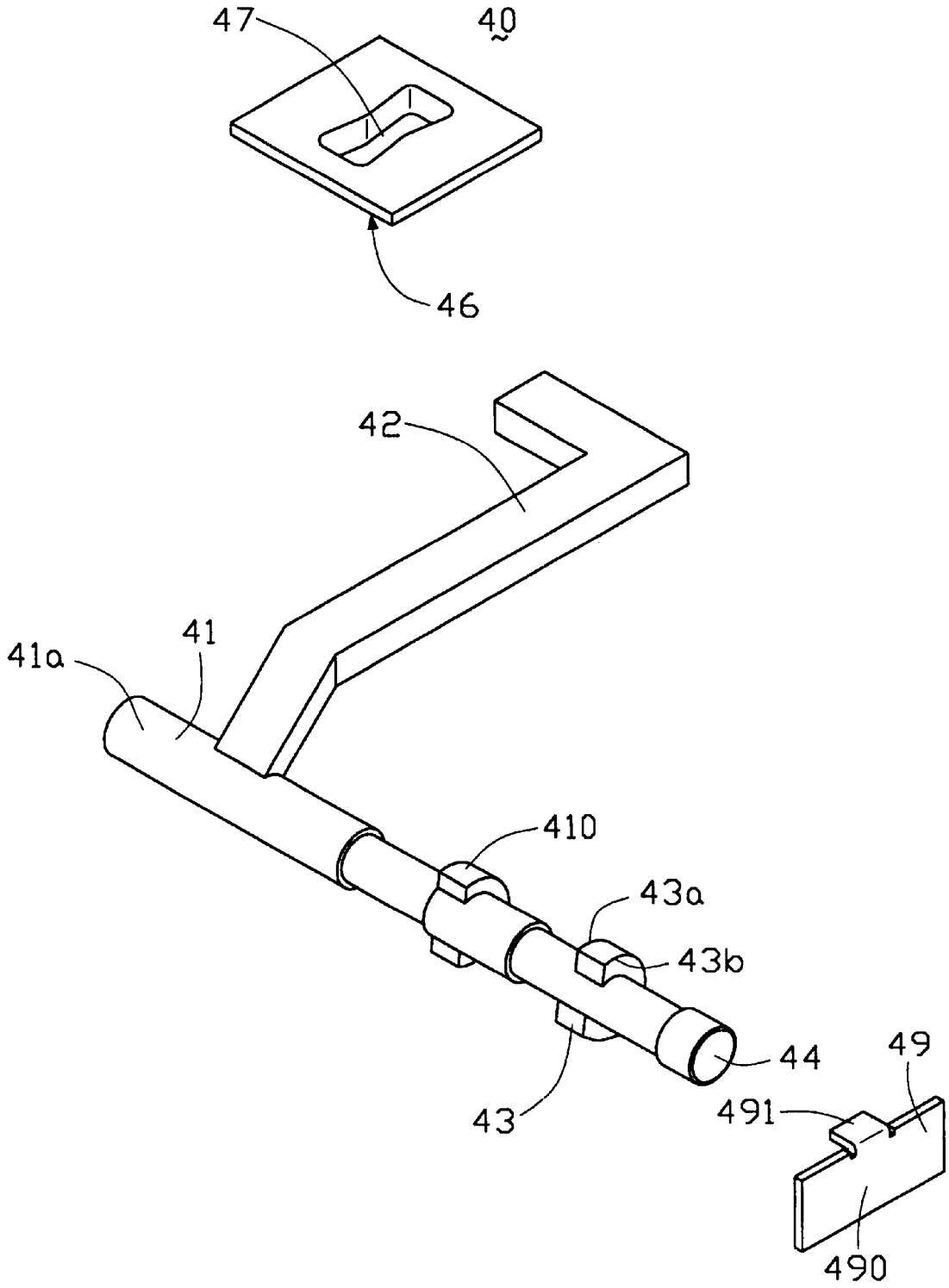
FIG. 2 is a perspective view of a driving device in accordance with the present invention.
Figure 3:
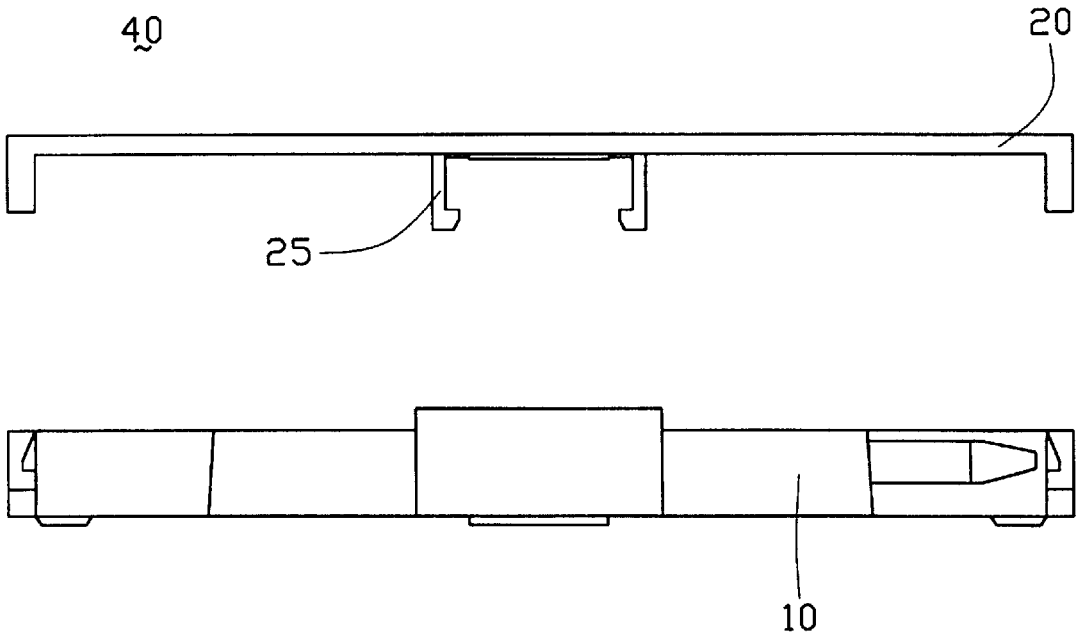
FIG. 3 is a side view of the electrical connector of FIG. 1.

Referring to FIGS. 1–8, an electrical connector 1 in accordance with a first embodiment of the present invention is used to electrically connect a chip module (not shown) to a printed circuit board (not shown). The electrical connector 1 comprises a base 10 securely assembled to the printed circuit board. The base 10 defines a plurality of passageways 11 therein and a lever rest 14 extending from a side thereof. Each passageway 11 receives a terminal 12. The passageway 11 has an elongate shape and the terminal 12 is located at a side thereof. The lever rest 14 defines a central slot 100 and a groove 102 in communication with central slot 100, wherein a recess 101 is defined in the central slot 100. A pair of gaps 103 is disposed at two edges of the base 10 and symmetric to an axis of the lever rest 14. In addition, a baffle 107 is defined at the outer end of the central slot 100, and a block 106 is defined at a side of one groove 102.

A cover 20 is assembled to the base 10 moveable along the axis of the lever rest 14 and defines an array of through holes 21 for extension of pins 31 of the chip module. Each through hole 21 of the cover 20 is partially aligned with a bottom portion 11*a* of the passageway 11 for the pin 31 of the chip module to electrically contact with the terminal 12. In addition, in order to provide an easy insertion of the pin 31 of the chip module, the cover 20 is moved such that the through hole 21 is shifted away from the lower portion 11*a* and to a top portion 11*b*, in other words, the through hole 21 is shifted away from the terminal 12. It should be noted that the top portion 11*b* and the bottom portion 11 a used herein is just for easy description with respect to the drawings, it shall not be construed as a limitation thereof. Once the through hole 21 is aligned to the top portion 11*b* of the passageway 11, the pin 31 of the chip module can be easily inserted into the passageway 11 of the base 10 without resistance.

The present invention addresses to a mechanism to drive the cover 20 to move between a first position in which the through hole 21 is aligned to the top portion 11*b* of the passageway 11, and a second position in which the through hole 11 is aligned with the bottom portion 11*a* of the passageway 11.

A driving device 40 in accordance with the present invention is arranged between the base 10 and the cover 20 to drive the cover 20 to move between the first and the second positions. The driving mechanism 40 includes a driving shaft 41 and a lever arm 42 linked to an end 41a of the driving shaft 41. The driving shaft 41 includes a helical section 43 extending along the driving shaft 41 and a bearing section 410 between the helical section 43 and the lever arm 42. The driving device 40 further includes a follower 46 having a slot 47 capable of partially receiving an edge 43*a* or 43*b* of the helical section 43.

In order to assemble the driving device 40 to the electrical connector 1, the base 10 comprises a shaft seat 13 in which the driving shaft 41 can be rotationally seated therein, and the lever rest 14 is adjacent to the shaft seat 13 for retaining the driving shaft 41 and the lever arm 42. The shaft seat 13 includes an enlarged section for receiving the helical section 43 of the driving shaft 41. The cover 20 defines an opening 22 for positioning the follower 46 therein. The opening 22 is arranged corresponding to the shaft seat 13 of the base 10.

In assembly, the driving shaft 41 is seated in the shaft rest 13 and the follower 46 is securely positioned in the opening 22 of the cover 20, and the driving shaft 41 is received in the central slot 100, whereby the bearing section 410 is located in the recess 101 and the lever arm 42 is inclined about fifteen degrees to the base 10. When the cover 20 is assembled to the base 10, the edge 43*a* or 43*b* of the helical section 43 is just enveloped by the slot 47 of the follower 46. At the same time, the baffle 107 prevents the driving shaft 41 from moving outward, and the block 106 positions the lever arm 42 on a closed position.

As clearly shown in the Figures, the driving shaft 41 is seated in the shaft seat 13 and is not movable in an axial direction thereof. Accordingly, when the driving shaft 41 is rotated through certain degrees by the lever arm 42, the follower 46 is moved linearly by the edge 43*a* or 43*b* of the helical section 43 along the axial direction of the driving shaft 41. Because the follower 46 is fixedly attached to the cover 20, and the cover 20 is slidably assembled to the base 10, the cover 20 is moved linearly when the driving shaft 41 is rotated.

In the embodiment, the driving shaft 41 is rotated through 180 degrees to activate the linear movement of the cover 20 between the first and second positions. However, the helical section 43 can be arranged such that the driving shaft 41 only need be rotated through 90 degrees or other degrees to move the cover 20 between the first and the second positions. In addition, in order to ensure the proper engagement between the driving shaft 41 and the follower 46, the cover 20 is provided with a pair of clips 25 slidably engaging with a shoulder 13*a* of the shaft seat 13. Accordingly, the linear movement of the cover 20 and the engagement between the helical section 43 and the follower 46 can be ensured. Furthermore, a pair of sidewalls 48 extend from two sides of the cover 20, and four protrusions 108 are defined at four corners of the base 10 to engage with the sidewalls 48, thereby limiting over movement of the cover 20 with respect to the base 10. A shaft clip 49 is located between an end 44 of the driving shaft 41 and the shaft seat 13, and includes a platform 490 and a protrusion 491 extended from a side of the platform 490. The shaft clip 49 provides a solid interface and prevents shaft from lifting during the driving shaft 41 rotating.

Figure 4:
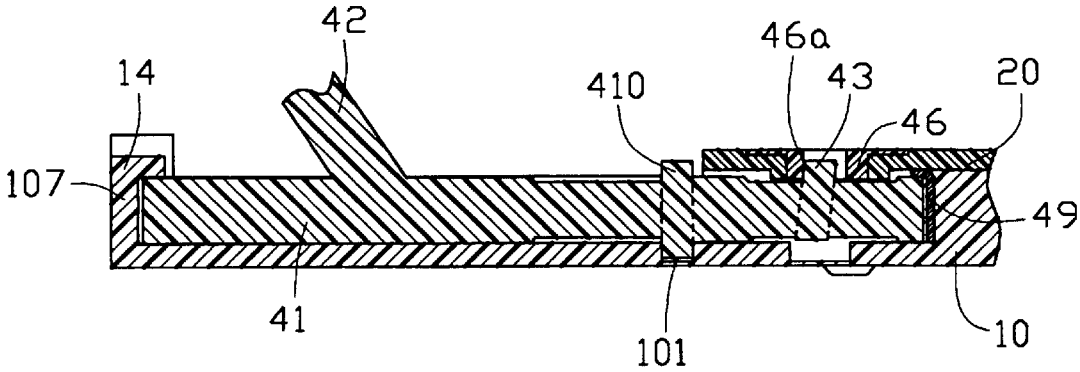
FIG. 4 is a cross-sectional view of the electrical connector showing a cover of the connector located at an open position.

Referring to FIG. 4, when the lever arm 42 rotates the driving shaft 41 from the opening position to the closed position, the edge 43*a* of the helical section 43 rotationally pushes an inner edge 46*a* of the follower 46, further the follower 46 pushes the cover 20 moving along the base 10 in a first direction. At the same time, an inner side of the recess 101 contacts with the bearing section 410, and the inner edge 46*a* of the follower 46 contacts with the edge 43*a* of the helical section 43, thereby making an axial force arisen during the rotation of the driving shaft 41 focus between the bearing section 41 and the helical section 46*a* of the driving shaft 41. Thus, in contrast to the recited prior art, the bearing section 410 can effectively reduce distortion of the driving shaft 41 during rotating anticlockwise.

Figure 5:
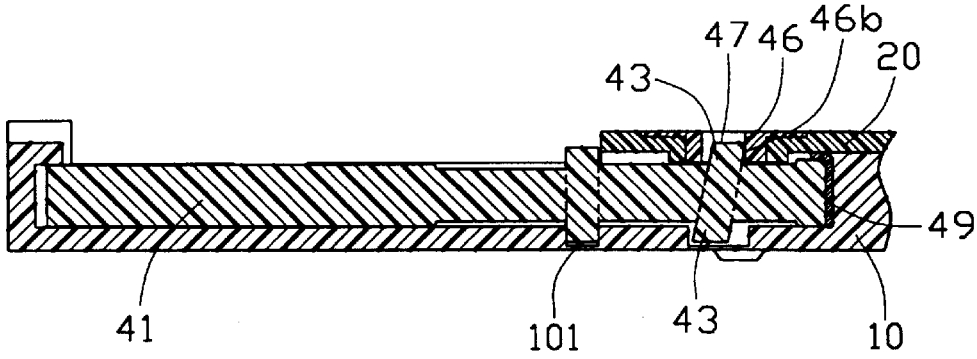
FIG. 5 is a cross-sectional view of the electrical connector showing the cover located at a closed position.
Figure 8:
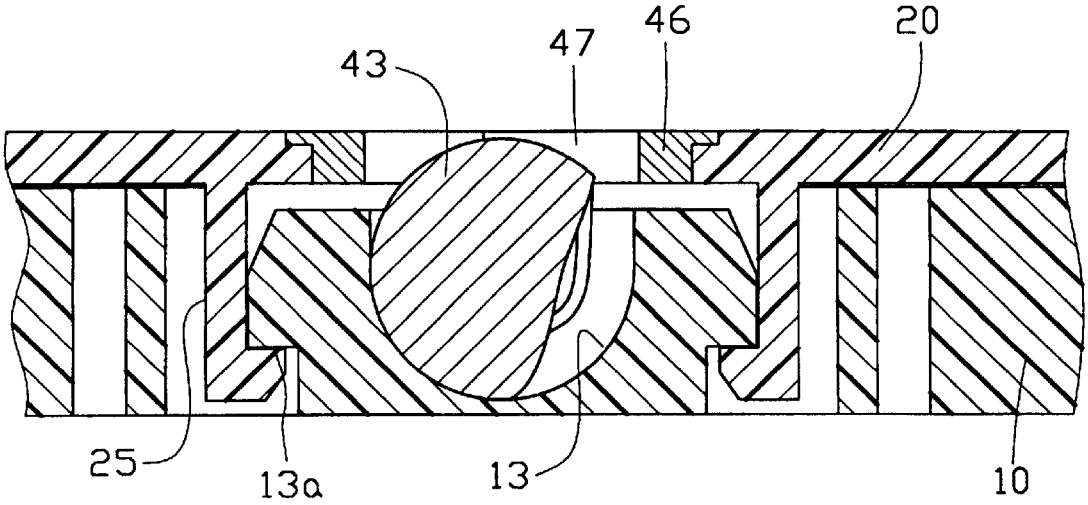
FIG. 8 is a cross-sectional view of the electrical connector after being assembled.
Figure 6:
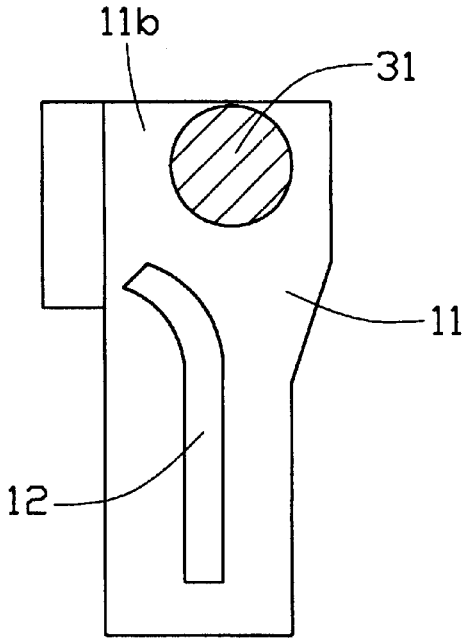
FIG. 6 is a top view showing a passageway of the base and a pin and a terminal in the passageway, wherein the pin and the terminal are disengaged from each other.
Figure 7:
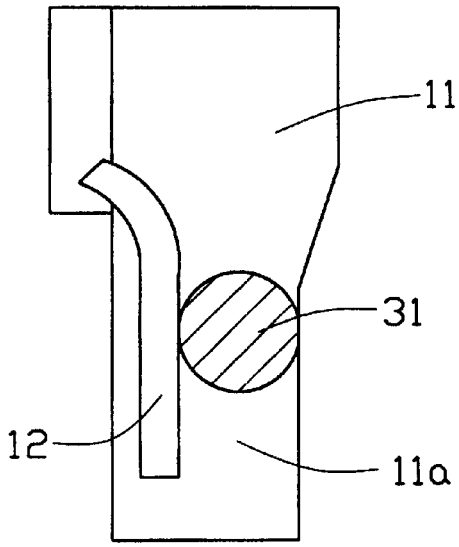
FIG. 7 is similar to FIG. 6 but the pin and the terminal are engaged with each other.

Referring to FIG. 5, when the lever arm 42 rotates the driving shaft 41 from the closed position to an opening position, the edge 43*b* of the helical section 43 rotationally pushes another inner edge 46*b* of the follower 46, further the follower 46 pushes moving the cover 20 moving along the base 10 in a second direction. At the same time, the inner edge 46*b* of the follower 46 contacts with the edge 43*b* of the helical section 43, and the end 44 of the driving shaft 41 contacts with the shaft clip 49, thereby making the axial force resulted during the rotation of the driving shaft 41 focuses between the helical section 43 of the driving shaft 41 and the shaft clip 49. Thus, in contrast to the recited prior art, the shaft clip 49 can effectively reduce the distortion of the driving shaft 41 during rotating clockwise and further obtain a stable stroke.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically assembling a pin grid array chip module to a printed circuit board, comprising:

a base having a plurality of passageways and a plurality of terminals received in the passageways;

a cover moveably assembled to said base and defining a plurality of through holes for extension of pins of a chip module, each through hole being aligned with a corresponding passageway; and a driving device arranged between said base and the cover to drivingly move said cover between a first portion in which said pin is away from said terminal and a second position in which said pin is electrically contacted with said terminal, said driving device including a driving shaft having a bearing section and a helical section rotatable therewith, and a follower moveable by said helical section when said driving shaft is rotated;

wherein, during an actuation stroke, an edge of the helical section pushes the follower in a first direction and the bearing section bears against a portion of the base along an opposite second opposite direction;

wherein the driving device includes a lever arm attached to an end of the driving shaft for rotating the driving shaft, and the bearing section is located between the helical section and the lever arm;

wherein the base defines a lever rest having a central slot for receiving the driving shaft and the lever arm, and the central slot has a recess to receive the bearing section;

wherein a groove is defined in the lever rest and is in communication with the central slot, and a block is defined at a side of the groove for locating the driving shaft;

wherein the base defines a shaft seat for rotatably receiving the driving shaft therein, the shaft seat including an enlarged portion for receiving the helical section of the driving shaft;

wherein a shaft clip is located between an end of the driving shaft and the shaft seat to bear against the end of the driving shaft when another edge of the helical section pushes the follower in the second direction.

2. The electrical connector as claimed in claim 1, wherein the shaft seat has a shoulder and the cover includes a pair of clips engaged with the shoulder.

3. The electrical connector as claimed in claim 1, wherein a pair of sidewalls extend from two sides of the cover, and four protrusions are defined at four corners of the base to engage with the sidewalls.

4. The electrical connector as claimed in claim 1, wherein the follower includes a slot matingly receiving the helical section of the driving shaft.

5. The electrical connector as claimed in claim 1, wherein the cover includes an opening for retaining the follower therein.

6. An electrical connector for electrically assembling a pin grid array chip module to a printed circuit board, comprising:

a base having a plurality of passageways and a plurality of terminals received in the passageways;

a cover moveably assembled to said base and defining a plurality of through holes for extension of pins of a chip module, each through hole being aligned with a corresponding passageway;

a driving device arranged between said base and the cover to drivingly move said cover between a first portion in which said pin is away from said terminal and a second position in which said pin is electrically contacted with said terminal, said driving device including a driving shaft having a helical section rotatable therewith and a follower moveable by said helical section when said driving shaft is rotated; and a shaft clip located in the base proximate to an end of the driving shaft, the shaft clip including a platform and a protrusion extending from a side of the platform;

wherein, during a de-actuation stroke, the shaft clip bears against the end of the driving shaft in a first direction and an edge of the helical section pushes the follower in an opposite second direction;

wherein the driving device includes a lever arm attached to an end of the driving shaft for rotating the driving shaft;

wherein the base defines a lever rest having a central slot for receiving the driving shaft and the lever arm;

wherein the driving shaft defines a bearing section between the lever arm and the helical section, and the central slot defines a recess to receive the bearing section when another opposite edge of the helical section pushes the follower in the first direction.

7. The electrical connector as claimed in claim 6, wherein a groove is defined in the lever rest and is in communication with the central slot, and a block is defined at a side of the groove for locating the driving shaft.

8. The electrical connector as claimed in claim 7, wherein the shaft seat has a shoulder and the cover includes a pair of clips engaged with the shoulder.

9. The electrical connector as claimed in claim 7, wherein the shaft clip is located between an end of the driving shaft and the shaft seat.

10. The electrical connector as claimed in claim 6, wherein the base defines a shaft seat for rotatably receiving the driving shaft therein, the shaft seat including an enlarged portion for receiving the helical section of the driving shaft.

11. The electrical connector as claimed in claim 6, wherein a pair of sidewalls extend from two sides of the cover, and four protrusions are defined at four corners of the base to engage with the sidewalls.

* * * * *